US007850421B2

(12) United States Patent
Bättig et al.

(10) Patent No.: US 7,850,421 B2
(45) Date of Patent: Dec. 14, 2010

(54) STATOR ARRANGEMENT FOR TURBINE

(75) Inventors: Josef Bättig, Egliswil (CH); Robert Dötl, Nussbaumen (CH)

(73) Assignee: ABB Turbo Systems AG, Baden (CH)

( * ) Notice: Subject to any disclaimer, the term of this patent is extended or adjusted under 35 U.S.C. 154(b) by 180 days.

(21) Appl. No.: 11/806,647

(22) Filed: Jun. 1, 2007

(65) Prior Publication Data

US 2008/0107520 A1 May 8, 2008

Related U.S. Application Data

(63) Continuation of application No. PCT/CH2005/000694, filed on Nov. 24, 2005.

(30) Foreign Application Priority Data

Dec. 8, 2004 (EP) ..... 04405762

(51) Int. Cl.
*F01D 17/16* (2006.01)

(52) U.S. Cl. ..... 415/160

(58) Field of Classification Search ..... 415/160
See application file for complete search history.

(56) References Cited

U.S. PATENT DOCUMENTS 3,303,992 A * 2/1967 Johnson ..... 415/160
3,954,349 A * 5/1976 Abild ..... 415/160
3,972,644 A * 8/1976 Johnson ..... 415/163
4,239,450 A * 12/1980 Geitner et al. ..... 415/160
4,430,043 A * 2/1984 Knight et al. ..... 415/159
4,684,319 A * 8/1987 Sasaki ..... 415/164

(Continued)

FOREIGN PATENT DOCUMENTS

DE 1 503 527 8/1969

(Continued)

OTHER PUBLICATIONS

English Translation. DE 1503527 A. Schreiber Translations, Inc. Jun. 2009. pp. 1-10.*

(Continued)

*Primary Examiner*—Richard Edgar
(74) *Attorney, Agent, or Firm*—Buchanan Ingersoll & Rooney PC

(57) ABSTRACT

A stator arrangement, or distributor, for a turbine machine is disclosed which includes a guide blade. The blade shaft is supported to be able to pivot around the pivot axis, with a part which is to be guided being situated to the outside. The pivoting device contains a setting ring which is located outside a flow channel and which can be pivoted around the turbine axis, and adjusting levers which transmit torque from the setting ring to the blade shaft of each guide blade. The adjusting lever is slipped with one end onto the blade shaft. The other end can be configured as a ball head, the adjusting levers being guided in a groove of the setting ring. The surface which acts on the ball head of the adjusting lever for transmission of torque from the setting ring to the blade shaft of each guide blade can be configured as a ball socket. Exemplary embodiments can yield a uniform large-area pressure distribution by which the wear of the parts which press on one another can be distinctly reduced.

13 Claims, 5 Drawing Sheets

U.S. PATENT DOCUMENTS

| | | | | |
|---|---|---|---|---|
| 4,836,746 | A * | 6/1989 | Owsianny et al. | 415/160 |
| 4,867,635 | A | 9/1989 | Tubbs | |
| 5,025,629 | A * | 6/1991 | Woollenweber | 415/160 |
| 5,316,438 | A * | 5/1994 | Tubbs | 415/160 |
| 2004/0009061 | A1 * | 1/2004 | McDonald | 415/151 |

FOREIGN PATENT DOCUMENTS

| | | | |
|---|---|---|---|
| DE | 1503527 | A * | 8/1969 |
| DE | 100 13 335 | A1 | 9/2001 |

OTHER PUBLICATIONS

PCT/ISA/210.
PCT/ISA/237.
Translation of the International Preliminary Report filed with the First IDS on Jun. 1, 2007.

* cited by examiner

STATOR ARRANGEMENT FOR TURBINE

CROSS REFERENCE TO RELATED APPLICATIONS

This application claims priority under 35 U.S.C. §119 to European Application No. 04405762.8 filed in Europe on Dec. 8, 2004, and as a continuation application under 35 U.S.C. §120 to PCT/CH2005/000694 filed as an International Application on Nov. 24, 2005 designating the U.S., the entire contents of which are hereby incorporated by reference in their entireties.

BACKGROUND

1. Field

A stator arrangement, or distributor, of a turbine machine, for example, of an exhaust gas turbine or a compressor is disclosed. In an exhaust gas turbine which is exposed to axial incident flow, such a distributor is connected upstream of the moving blades of the turbine and has guide blades in the exhaust gas-carrying flow channel which are arranged axial-symmetrically to the turbine axis and which can each be pivoted around a radially guided axis, and a pivoting device which moves the guide blades around the pivot axis. With this distributor, by pivoting the guide blades, the size of the cross section area of the flow channel through which the exhaust gas flows can be changed and the exhaust gas turbine can be adapted to changing exhaust gas flows, as occur for example in partial load operation of an internal combustion engine which delivers an exhaust gas.

2. Background Information

A distributor is described for example in DE 100 13 335 A1. In this distributor, concentrically to the moving wheel of the turbine there is a setting ring which is located radially outside in the flow channel. A blade shaft which is guided out of the flow channel through the housing wall radially to the outside is attached to each of the guide blades. The blade shaft is supported to pivot around the pivot axis with its part which is guided to the outside. The pivoting device contains a setting ring which is located outside the flow channel and which can be pivoted around the turbine axis, and adjusting levers which transmit torque from the setting ring to the blade shaft of each guide blade.

The adjusting levers are slipped with one end onto the blade shaft. With the other end the adjusting levers are guided in the grooves of the setting ring. The grooves are bordered by two radially guided groove walls, with a distance from one another which is somewhat greater than the diameter of the ends of the adjusting levers, which ends are made as a ball head and are guided in the grooves.

Due to the rotational and pivoting motion, the ball head of the adjusting lever is moved on the surface of the groove walls. Based on the point support of the balls in the grooves of the adjusting lever, very high Hertzian stresses can occur in spite of moderate normal forces. The relative movements of the balls on the surface of the groove walls and the high surface pressures can lead to wear on the sliding partners in operation.

Patents U.S. Pat. No. 5,316,438 and U.S. Pat. No. 4,867,635 and patent disclosure document DE 1 503 527 A1 disclose distributors with adjustable guide blades. The adjustment mechanisms of these distributors have adjusting devices which transmit force from a setting ring to the shafts of the guide blades to adjust the guide blades. The adjusting levers are provided on one end with a ball head and engage ball sockets with it in the region of the setting rings.

SUMMARY

A stator component, or distributor, for a turbine machine is disclosed wherein a surface which acts on a ball head of adjusting levers for transmission of torque to a blade shaft of each guide blade is configured as ball socket, the ball socket being formed at least partially from slide elements which are arranged to be able to move translationally. Such features can yield a uniform, large-area pressure distribution by which the wear of the parts which press on one another can be distinctly reduced.

In an exemplary embodiment, there are guide shoes in grooves of a setting ring, which are configured as a ball socket and in which the ball heads of the adjusting levers are located. For an exemplary embodiment, the guide shoes can be easily and very economically produced.

BRIEF DESCRIPTION OF THE DRAWINGS

Various exemplary embodiments of a distributor are detailed below using the drawings, wherein like elements have been designated by like reference numbers, and wherein.

DETAILED DESCRIPTION

Figure 8:
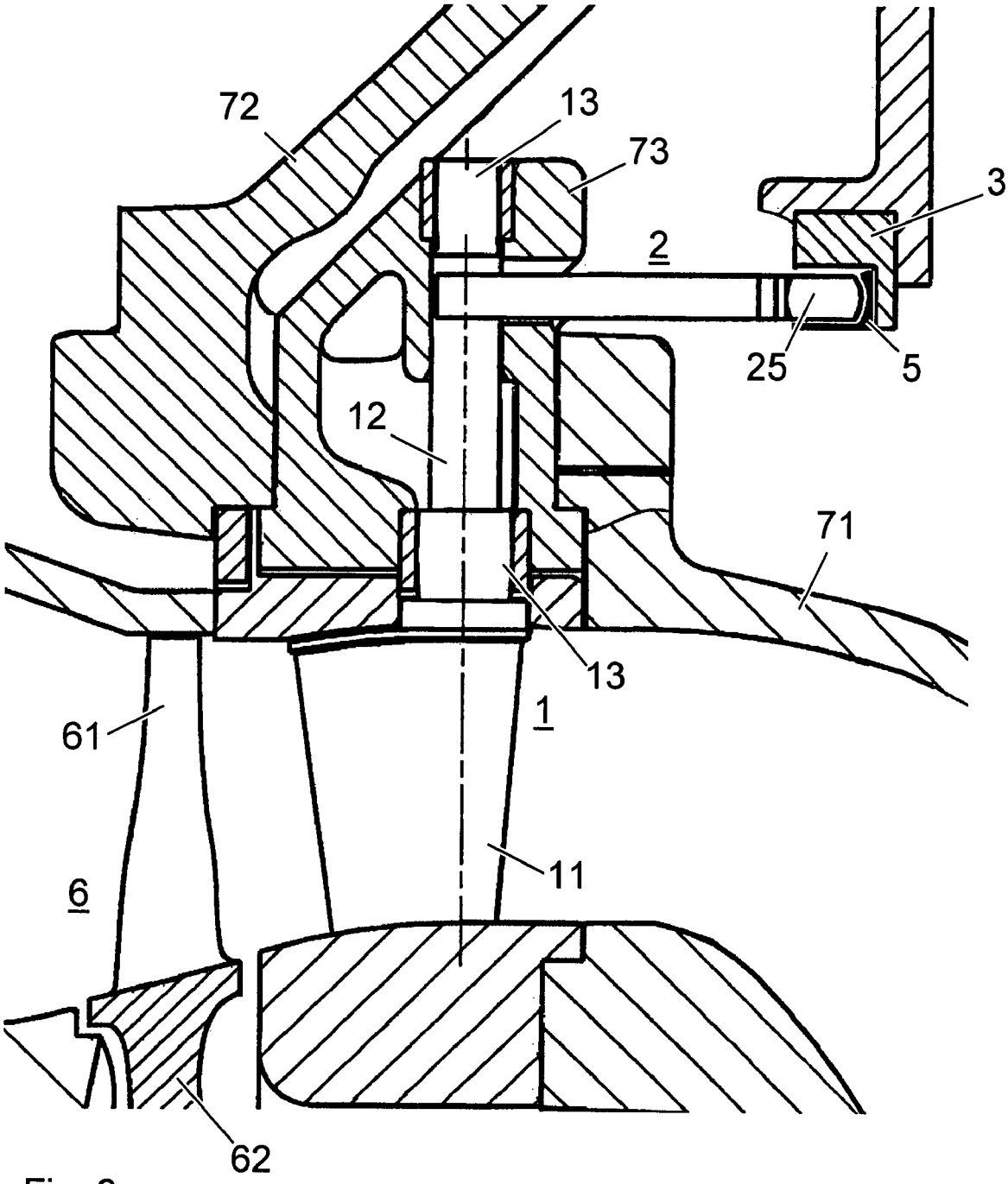
FIG. 8 shows a section through an exemplary exhaust gas turbine with a distributor.

FIG. 8 shows an exemplary turbine part of an exemplary turbine machine shown as an exhaust gas turbocharger. The exhaust gas turbine comprises a turbine wheel 6 which can be turned around an axis and which is located on a shaft with a blade carrier 62 and moving blades 61 which are attached to it. Moreover the exhaust gas turbine comprises a turbine housing and a distributor with a rim of movable guide blades 11 which is located axial-symmetrically to the turbine axis and with a pivoting device. The guide blades can each be pivoted by turning around the pivot axis of a pivotally mounted blade shaft 12 which is guided in the radial direction into any angular positions between two end positions.

The shaft on whose one end the turbine blade carrier is mounted is routed gas-tight out of the housing to a bearing point which is not shown and on its other end bears a compressor wheel which is likewise not specifically shown in FIG. 8.

The turbine housing contains a gas inlet housing 71 with an inlet opening arranged axial-symmetrically and a gas exit housing 72 with a radially aligned exit opening. Between the inlet and outlet opening a flow channel which is bordered by the turbine housing extends. Hot gas from an exhaust gas source which is not shown, especially an internal combustion engine, is supplied through the inlet opening. This hot gas is first routed in a section of the flow channel which is aligned in the direction of the turbine axis. In this section the exhaust gas is routed over the guide blades 11 and the moving blades 61. Downstream of the moving blades the exhaust gas enters a section of the flow channel which is bordered by the gas exit housing and in which it is routed radially to the outside away from the axis and is finally removed from the turbine housing via the exit opening.

The distributor is held on a support ring 73 which is clamped between the gas inlet housing 71 and the gas exit housing 72. Furthermore, a relief ring which is thermally decoupled from the support ring is clamped between the two housings and borders the flow channel radially to the outside in the region of the guide blades 11 and in this way shields the support ring against the direct action of hot exhaust gases and thus thermally relieves it. Each guide blade 11 forms a unit with the attached blade shaft 12. The blade shaft is guided out of the flow channel radially to the outside through the housing wall. The blade shaft with its outwardly guided part is mounted to be able to turn around the radially pointed pivot axis which is shown by the broken line. The rotary motion is initiated by a setting ring 3 which is located outside the flow channel and which can turn around the turbine axis and by adjusting levers 2 which transmit torque from the setting ring 3 to the blade shaft 12 of each guide blade.

The part of the blade shaft 12 which is guided to the outside is supported at two locations 13 which are arranged radially offset against one another. The two bearing points 13 are located in the support ring 73 which is used as a section of the housing.

Figure 1:
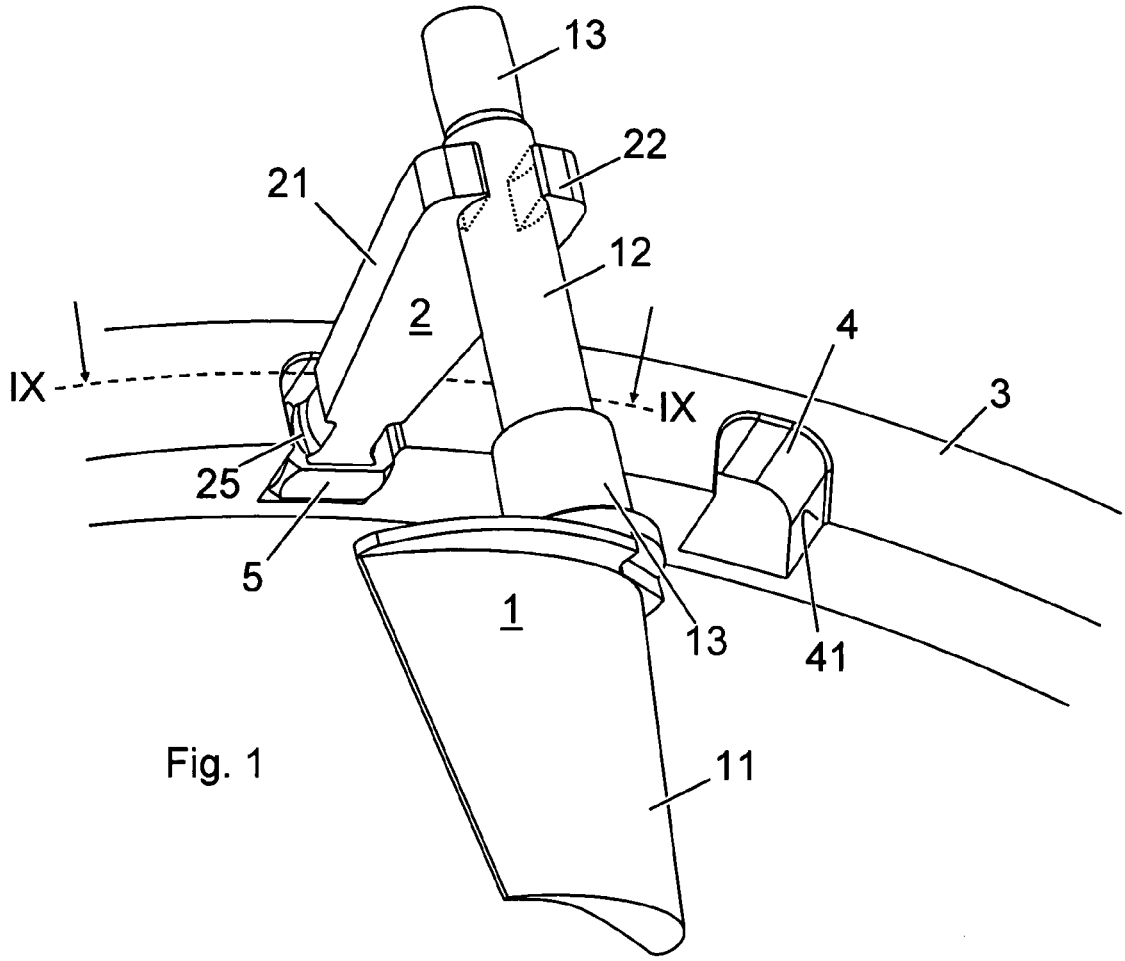
FIG. 1 shows an isometric view of a first exemplary embodiment of a distributor with a guide shoe which is seated radially on a ball head of an adjusting lever in a mounted state in a setting ring.

The adjusting lever 2 is connected on one end by a plug connection to the blade shaft 12. As FIG. 1 shows, the end of the adjusting lever has two claws 22 which are arranged in the manner of fork tines and which are slipped onto two holding surfaces of the blade shaft 12 which are guided plane-parallel. The holding surfaces are located between the two bearing points 13. On its other end the adjusting lever 2 is guided in a groove of the setting ring 3. The adjusting lever 2 is made on its end which is guided in the groove 4 of the setting ring 3 in the manner of a ball head 25. In an exemplary embodiment, the ball head 25 engages a ball socket which is made in the groove 4. The ball surface of the ball head which is present at least in sections slides around the pivot axis on the likewise at least partially present ball surface of the ball socket when the adjusting lever 2 is pivoted as caused by the turning of the setting ring 3. In the illustrated exemplary embodiments, the ball head has bilateral flattened regions which allow reduction of the groove height without adversely affecting the wobbling of the ball head in the ball socket in the region which is relevant to operation of the pivoting device.

Figure 9:
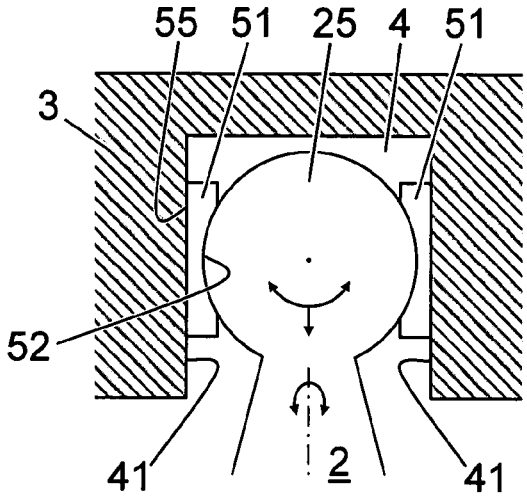
FIG. 9 shows a section routed along IX-IX through the distributor as shown in FIG. 1 with the adjusting lever in a middle position.
Figure 10:
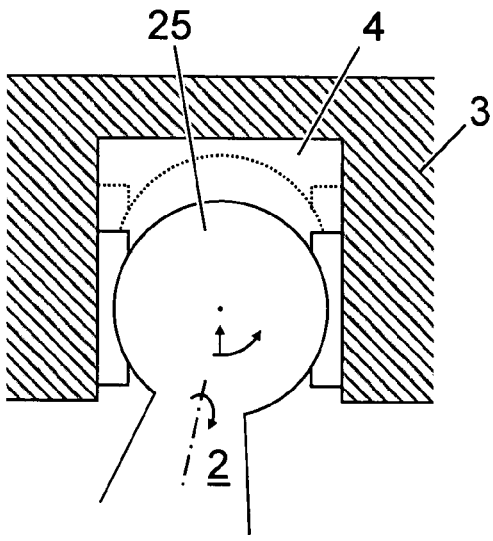
FIG. 10 shows the section as shown in FIG. 9 with a slightly pivoted adjusting lever.

In the exemplary embodiments shown in the figures, the groove 4 in the peripheral direction is bordered by essentially radially guided groove walls 41 which run parallel to one another. In the exemplary embodiment shown, the middle plane between the two groove walls runs exactly in the radial direction, while the two groove walls which run parallel to one another deviate slightly from the radial direction. As is shown in FIGS. 9 and 10 in the section through the arrangement as shown in FIG. 1, the ball socket is formed by two slide elements 51 which each have a plane surface 55 and a spherical surface 52 on opposite sides. The slide elements lie on opposing sides of the ball head 25 with plane surfaces 55 on the groove walls 41 which run parallel to one another and hold the ball head 25 with their spherical surfaces 52.

When the adjusting ring 3 for adjusting the guide blades 1 is turned, the slide elements 51 are pushed from the ball head in the groove 4 in the plane of the groove surfaces 41. If the setting ring in FIG. 9 is turned away to the right, the location of the adjusting level changes relative to the setting ring. In addition to the translational displacement of the center of rotation of the ball head which is apparent in FIG. 10 within the groove 4, the adjusting lever 2 is twisted with respect to the setting ring. The translational displacement of the center of rotation of the ball head is enabled by the slide elements 51 which slide along the groove walls 41, while for twisting purposes the ball head 25 can optionally be twisted in the ball socket 52 which is shaped by the two slide elements 51 in any direction.

By a small projection which runs peripherally at least partially on the axial edge of the groove, the ball head which is inserted into the groove in the radial direction, i.e. from underneath in FIG. 1, together with the slide elements 51 can be prevented from falling out in the axial direction, i.e. in FIG. 1 in the direction of the adjusting lever 2. This can also be prevented by the pivoting motion of the setting ring and/or the moving blades being limited elsewhere.

The two slide elements 51 can be fitted independently of one another between the ball head 25 and the respective groove walls 41. For facilitated installation, the two slide elements can also be made as the legs of a guide shoe 5 which additionally encompasses a connecting piece 53 which holds the two legs together.

Alternatively to the illustrated exemplary embodiment with the slide elements 51, the ball socket can also be inlet directly into the groove walls. In any case, the freedom of motion of the adjusting lever with respect to the setting ring would have to be ensured by other means. For example, for this purpose the adjusting lever can include an elastically stretchable shaft which can stretch and bend up to a certain degree.

Figure 2:
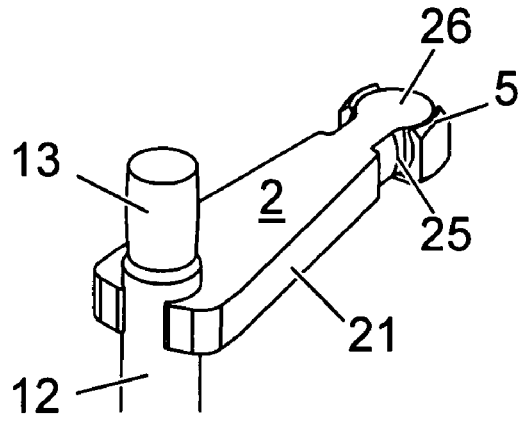
FIG. 2 shows a detailed view of the distributor as shown in FIG. 1 in an installed state without the setting ring.
Figure 3:
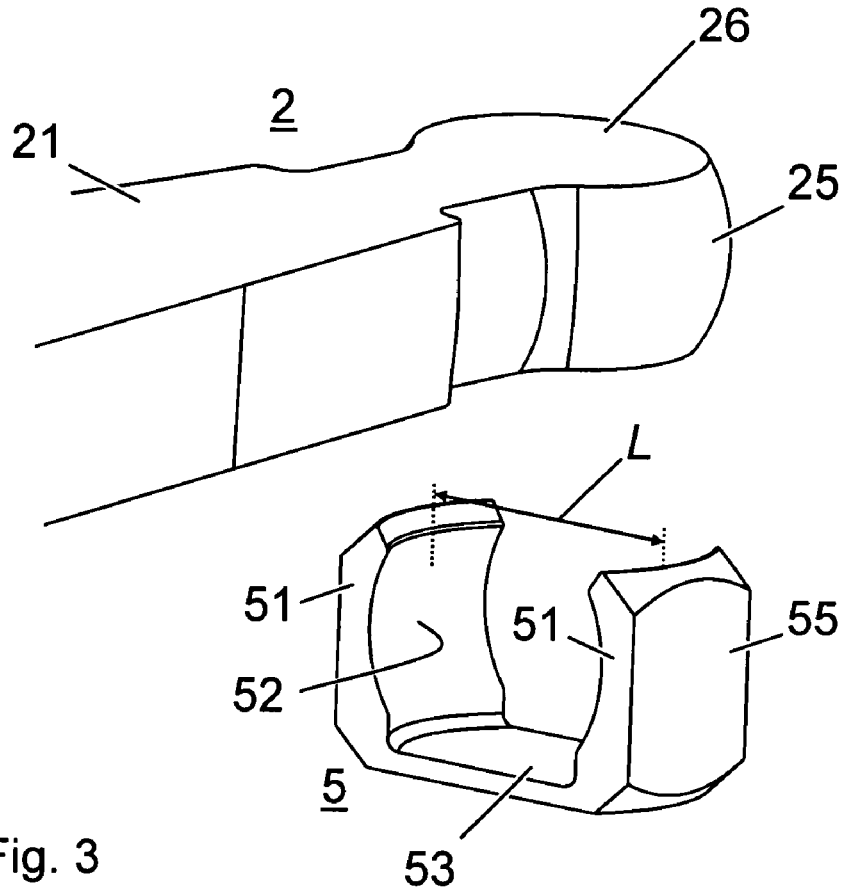
FIG. 3 shows the distributor as shown in FIG. 2 in a dismounted state.

FIGS. 2 and 3 show a first exemplary embodiment of the distributor is explained in greater detail; in it the guide shoe is pushed onto the adjusting lever in the radial direction, i.e. transversely to the adjusting lever. The guide shoe 5 has two legs 51 which are connected to one another via a flattened connecting element 53. The legs are shaped on the inside in the manner of a ball socket 52, and therefore have at least partially one spherical surface. When the guide shoe 5 is mounted on the adjusting lever 2, the opening of the guide shoe is pushed from underneath over the ball head 25 until the ball socket 52 rests on the ball. The legs 51 of the guide shoe are dimensioned such that they deform only elastically when mounted. The opening of the guide shoe has an inside width L which, in an exemplary embodiment, is roughly 10% smaller than the ball diameter of the ball head or the ball socket. With an opening of this magnitude, the ball can be easily pushed through the opening and afterwards is held securely in the ball socket. As shown in FIG. 3, the edges of the opening can be additionally slightly beveled for purposes of being slipped on more easily.

Due to the flattened regions on the bottom of the adjusting lever 26 and on the guide shoe 53 in the exemplary embodiment illustrated, the guide shoe after installation cannot turn relative to the adjusting lever. The flattened regions which are spaced apart from one another can however prevent the limited wobbling which can be desired for operation of the positioning device, but allow more extensive twisting which could lead to loosening of the connection between the ball head and the ball socket in an extreme case. The locking against rotation by the flattened region can also provide protection against loss which prevents the mounted guide shoe from falling off the adjusting lever and being lost.

Figure 4:
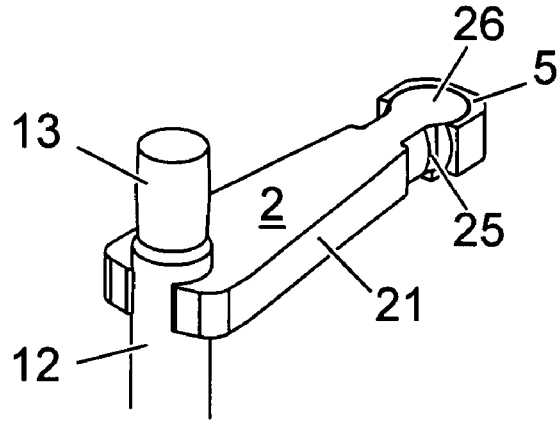
FIG. 4 shows a detailed view of a second exemplary embodiment of a distributor with a guide shoe which is seated axially on a ball head of an adjusting lever in a mounted state without a setting ring.
Figure 5:
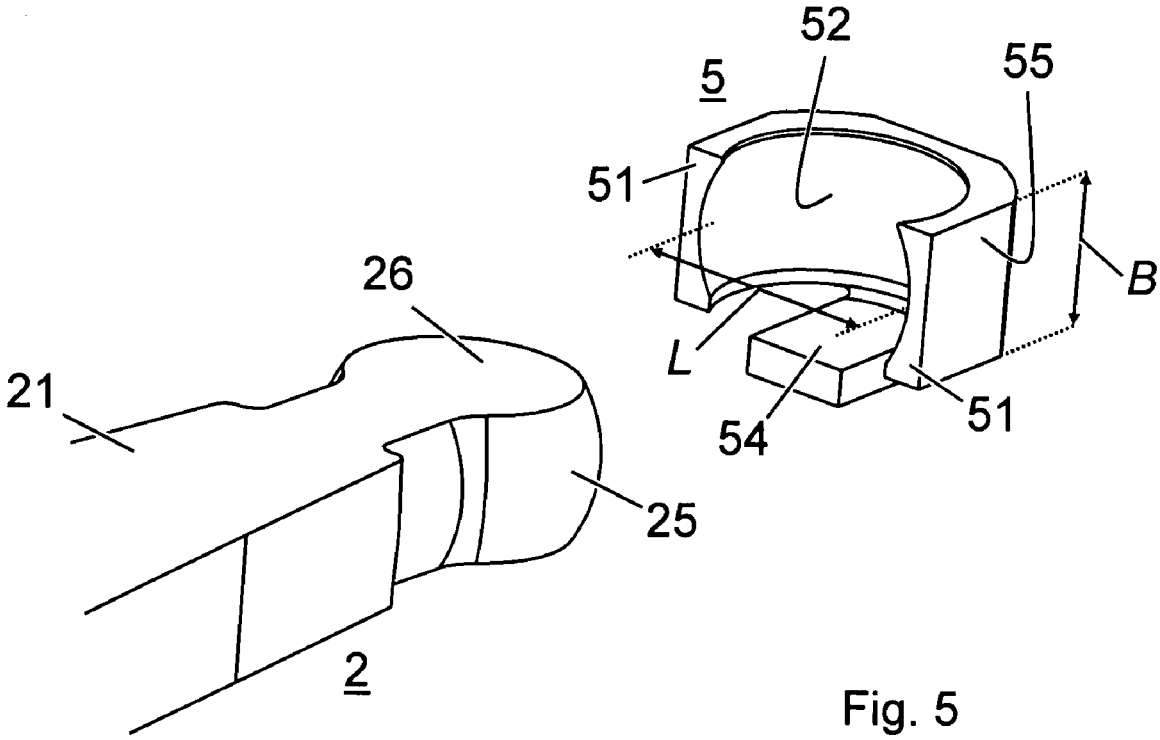
FIG. 5 shows the distributor as shown in FIG. 4 in a dismounted state.

FIGS. 4 and 5 show an exemplary second embodiment of the distributor in greater detail, in which the guide shoe is pushed onto the adjusting lever in the axial direction, i.e., lengthwise to the adjusting lever.

In this embodiment, due to the flattening of the ball head, the height B of the guide shoe and the radial groove height in the setting ring can be reduced. In order to prevent rotation of the guide shoe and possible loosening of the connection between the ball head and the ball socket, there is an anti-rotation device 54 which can be made as an additional, flattened leg. If there is addition axial flattening of the ball head on the end of the adjusting lever, the axial depth of the grooves 4 can be reduced.

Figure 6:
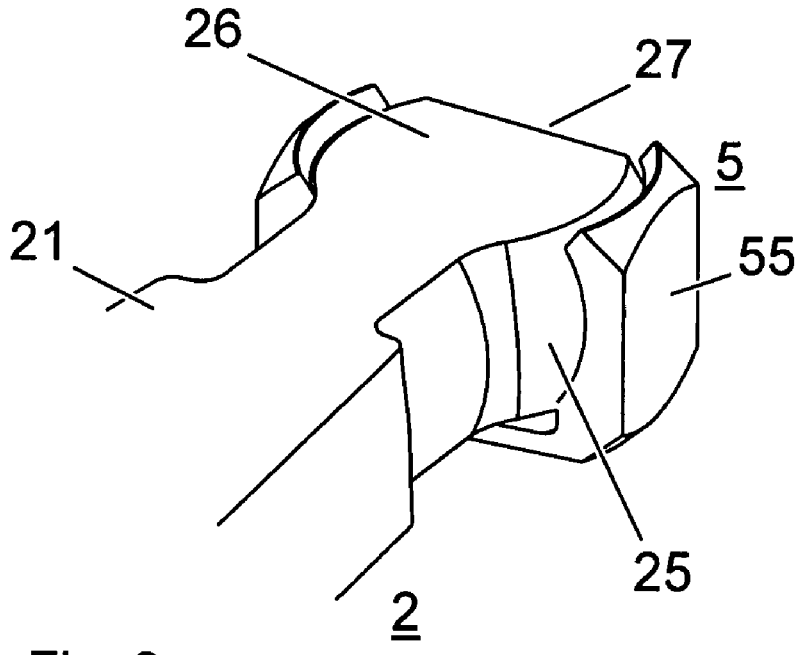
FIG. 6 shows a detailed view of the embodiment of the distributor as shown in FIG. 2, with a flattened region on the end of an adjusting lever.
Figure 7:
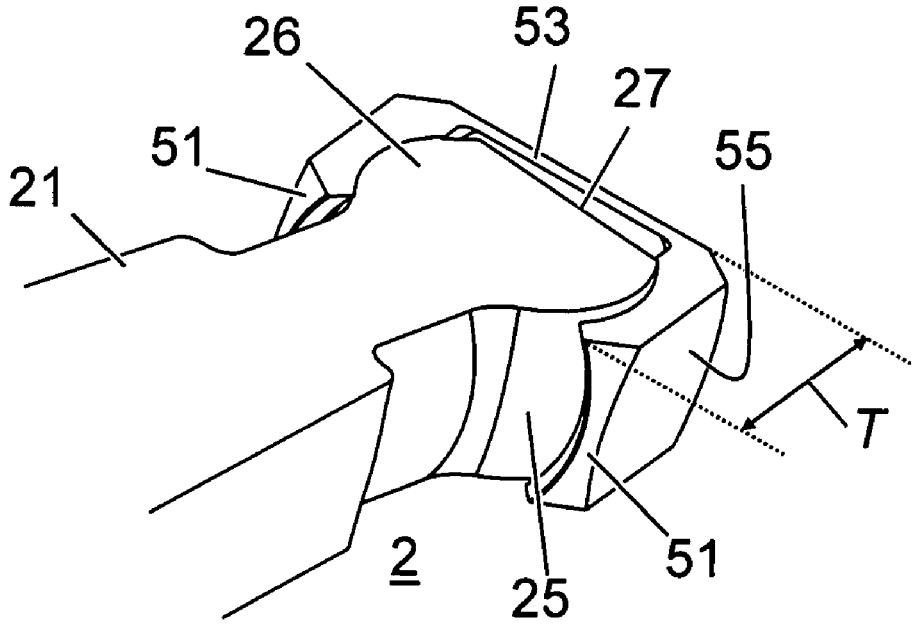
FIG. 7 shows a detailed view of an exemplary embodiment of a distributor as shown in FIG. 4, with a flattened region on the end of the adjusting lever.

FIG. 6 and FIG. 7 show the ball heads and guide shoes of the first and second exemplary embodiments which are made in this way. In the second embodiment, the flattened region of the ball head has an exemplary distance from the ball center which is less than the distance of the flattened region 53 of the guide shoe, so that there is the freedom of motion of the adjusting lever which can be desired for operation of the positioning device.

In an alternate exemplary embodiment, the distributor can be configured for producing a pretwist in the intake region of the compressor. This compressor can be used for example in an exhaust gas turbochargers. The pretwist distributor can include a pivotable setting ring which transmits torque to the blade shafts of the guide blades via adjusting levers as described herein.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBER LIST

1 guide blade unit
11 guide blade
12 blade shaft
13 bearing points
2 adjusting lever
21 shaft
fork-shaped end
25 ball head
26 surface flattened region
27 deep flattened region
3 setting ring
4 grooves
41 groove wall, slide surface
5 guide shoe
51 slide element, leg of guide shoe
52 ball socket
53 connecting element, flattened region
54 anti-rotation device
55 plane slide surface
6 turbine wheel
61 moving blades
62 turbine wheel blade carrier
71 gas inlet housing
72 gas exit housing
73 support ring

What is claimed is:

1. Stator arrangement for a turbine machine, comprising:
a guide blade configured to pivot around a pivot axis of a blade shaft which is connected to the guide blade;
a pivoting setting ring;
an adjusting lever for transmitting torque from the setting ring to the blade shaft of the guide blade, the adjusting lever being guided with one end configured as a ball head in a groove of the setting ring; and
a surface which acts on the ball head of the adjusting lever for transmission of torque from the setting ring to the blade shaft of the guide blade, the surface being configured as a ball socket formed at least partially by a spherical surface on slide elements, the slide elements having a planar surface on an opposing side of the spherical surface and being arranged for translational movement in both the axial and the radial direction in the groove,
wherein the groove is bordered at least partially by groove walls which run parallel to one another, and wherein the slide elements are located on opposing sides of the ball head between the ball head and one of the groove walls which run parallel to one another, and
wherein the slide elements are made as legs of a guide shoe which encompasses a connecting piece which connects the legs to one another.

2. Stator arrangement as claimed in claim 1, wherein the ball socket has an opening for inserting the ball head of an adjusting lever, with an inside width (L) which is smaller than a ball diameter of the ball head of the adjusting lever.

3. Stator arrangement as claimed in claim 1, wherein the legs of the guide shoe can be elastically deformed when the ball heads are inserted into the ball sockets.

4. An exhaust gas turbocharger, comprising an exhaust gas turbine with a stator arrangement as claimed in claim 1.

5. Exhaust gas turbocharger, comprising a compressor with a stator arrangement as claimed in claim 1 configured as a pretwist compressor for producing a pretwist in an intake region of the compressor.

6. Stator arrangement for a turbine machine, comprising:
a guide blade configured to pivot around a pivot axis of a blade shaft which is connected to the guide blade;
a pivoting setting ring;
an adjusting lever for transmitting torque from the setting ring to the blade shaft of the guide blade, the adjusting lever being guided with one end configured as a ball head in a groove of the setting ring; and
a surface which acts on the ball head of the adjusting lever for transmission of torque from the setting ring to the blade shaft of the guide blade, the surface being configured as a ball socket formed at least partially by slide elements, the slide elements being arranged to move in the groove;
wherein the ball socket has at least one flattened region which has a distance to the ball center which is smaller than a radius of the ball, and wherein the ball head of the adjusting lever has at least one flattened region which has a distance to the ball center which is smaller than a distance to a ball center of flattened region of the ball socket.

7. Stator arrangement as claimed in claim 6, wherein to reduce a depth of the groove in the setting ring, there is at least one flattened region of the ball head of the adjusting lever on an end of the adjusting lever and there is at least one flattened region of the ball socket opposite the flattened region of the end of the adjusting lever.

8. Stator arrangement as claimed in claim 7, wherein the groove is bordered at least partially by groove walls which run parallel to one another, and wherein the slide elements are located on opposing sides of the ball head between the ball head and one of the groove walls which run parallel to one another.

9. Stator arrangement as claimed in claim 8, wherein the slide elements are made as legs of a guide shoe which encompasses a connecting piece which connects the legs to one another.

10. Stator arrangement as claimed in claim 9, wherein the legs of the guide shoe can be elastically deformed when the ball heads are inserted into the ball sockets.

11. An exhaust gas turbocharger, comprising an exhaust gas turbine with a stator arrangement as claimed in claim 6.

12. Exhaust gas turbocharger, comprising a compressor with a stator arrangement as claimed in claim 6 configured as a pretwist compressor for producing a pretwist in an intake region of the compressor.

13. An apparatus, comprising:

a blade configured to pivot around a pivot axis of a blade shaft which is connected to the blade;

a pivoting setting ring having a groove;

an adjusting lever for transmitting torque from the setting ring to the blade shaft of the blade, the adjusting lever having one end configured as a ball head in the groove of the setting ring; and a surface which acts on the ball head of the adjusting lever for transmission of torque from the setting ring to the blade shaft of the blade, the surface being configured as a ball socket formed at least partially by a spherical surface on slide elements, the slide elements having a planar surface on an opposing side of the spherical surface and being arranged for translational movement in both the axial and the radial direction in the groove, wherein the groove is bordered at least partially by groove walls which run parallel to one another, and wherein the slide elements are located on opposing sides of the ball head between the ball head and one of the groove walls which run parallel to one another, and wherein the slide elements are made as legs of a guide shoe which encompasses a connecting piece which connects the legs to one another.

* * * * *